United States Patent [19]

Mueller

[11] Patent Number: 4,768,891

[45] Date of Patent: Sep. 6, 1988

[54] TYPEWRITER LID ACTUATED PRINTING ELEMENT HOMING AND CARRIER REPOSITION DEVICE

[75] Inventor: Hans W. Mueller, Cortland, N.Y.

[73] Assignee: Smith Corona Corporation, Cortland, N.Y.

[21] Appl. No.: 918,964

[22] Filed: Oct. 15, 1986

[51] Int. Cl.[4] ..... B41J 1/30

[52] U.S. Cl. ..... 400/144.2; 400/54; 400/322

[58] Field of Search ..... 400/54, 144, 144.1, 400/144.2, 144.3, 320, 322, 328, 690.4, 691, 692

[56] References Cited

U.S. PATENT DOCUMENTS

| | | | |
|---|---|---|---|
| 4,389,129 | 6/1983 | Sugiura | 400/144.2 |
| 4,504,158 | 3/1985 | Ciampi et al. | 400/144.2 |
| 4,541,746 | 9/1985 | Bobart et al. | 400/144.2 |
| 4,605,324 | 8/1986 | Musso | 400/144.2 |
| 4,676,679 | 6/1987 | Kondo | 400/54 |

FOREIGN PATENT DOCUMENTS

| | | | |
|---|---|---|---|
| 51173 | 3/1983 | Japan | 400/54 |
| 124881 | 7/1984 | Japan | 400/54 |

*Primary Examiner*—David A. Wiecking

[57] ABSTRACT

The present invention is a typewriter lid actuated printing element homing device which uses a single switch for assuring that the printing element is engaged and maintained in its home position without any accompanying noise after the printing element is inserted, and also for assuring that the printing element is in its correct escapement position after the printing element is inserted. When the typewriter lid is closed, the carrier escapement position and the carrier motor phase is entered into memory. A latch member controlled by an actuator engages a notch in a flange of a rotating printing element drive gear for establishing the home position of the printing element. When the latch member engages the flange, the printing element drive gear motor is deenergized, stopping rotation of the drive gear, and the noise which would otherwise be caused by the print element drive motor continuously trying to rotate against the latch member is eliminated. The carrier is thereafter moved to its correct escapement position, which is the last print position occupied by the carrier when the lid was opened.

15 Claims, 3 Drawing Sheets

TYPEWRITER LID ACTUATED PRINTING ELEMENT HOMING AND CARRIER REPOSITION DEVICE

CROSS-REFERENCES TO RELATED APPLICATIONS

The subject matter contained herein is related to copending U.S. patent application Ser. No. 918,965 "Printing Element Homing Device" filed Oct. 15, 1986, and issued on May 24, 1988 as U.S. Pat. No. 4,746,235.

STATEMENT AS TO RIGHTS TO INVENTIONS MADE UNDER FEDERALLY SPONSORED RESEARCH AND DEVELOPMENT

The invention disclosed and claimed herein was not made under any federally sponsored research and development program.

BACKGROUND OF THE INVENTION

Field of the Invention

This invention is concerned with impact printing devices such as typewriters and, in particular, with such mechanisms in which the printing is achieved by a rotary device such as a daisy-type wheel or a cup-shaped printing element. Such elements typically include a plurality of spokes or petals each bearing a character or characters thereon.

A printing element of this type is commonly located on a carrier for movement along a print line direction during the printing operation. As the carrier is moved from print position to print position along the print line direction, the printing element is rotated about its axis for character selection purposes. When the printing element is in its proper position (i.e. when the character on the printing element to be printed is opposite the desired print position), the carrier is momentarily stopped and a print hammer on the carrier impresses the character on the printing element against an inking ribbon and a print receiving medium, such as paper.

After a printing operation occurs, the print hammer returns to its rest position and the printing element is rotated so that the next character on the printing element to be printed is opposite the desired print position. The next, and subsequent, printing steps occur in the same manner as described above, until a complete line has been printed. After printing a complete line, appropriate means are provided to move the carrier to the next starting line position for subsequent printing. A printing device which operates in this manner is the typewriter sold by SCM Corporation under the model "XE 5000."

In printing devices of this type, it is necessary to change the printing element from time to time when, for example, a new type font is desired or if the printing element becomes damaged. When that occurs, it is essential that means be provided to assure that the printing element is engaged and maintained in its home position after the printing element is inserted, and also that the printing element be in its correct escapement position after the printing element is inserted. Furthermore, it is highly desirable that the maintenance of the printing element in its home position be achieved without any accompanying noise. The purpose of the present invention is to provide such means.

Description of the Prior Art

U.S. Pat. No. 4,389,129 issued to T. Sugiura on June 21, 1983 for a "Type Wheel Printer" discloses means including a typewriter actuated switch for rotating a typewriter motor more than one turn in response to the closing of a typewriter cover or lid, so that the type wheel and a type wheel drive element are latched together for unison rotation. This patent does not, however, disclose a means for thereafter rotating the latched type wheel and type wheel drive element to its home position in response to the closing of the typewriter lid.

U.S. Pat. No. 4,279,523 issued to T. Ringle on June 21, 1983 for a "Power Recovery Apparatus for an Electric Typewriterp38 discloses means to automatically return the printing element of a typewriter to its correct escapement position when power is restored after a power interrupt. The patent is likewise not concerned with rotating the type wheel and type wheel drive element to its home position in response to the closing of the typewriter lid.

SUMMARY OF THE INVENTION

The present invention uses a single switch for controlling a first motor to rotate a newly inserted printing element to its home position and for controlling a second motor to reposition a carrier on which the printing element is mounted to the last print position occupied by the carrier prior to insertion of the printing element. In order to insert a new printing element in a typewriter of the type with which the present invention is used, it is necessary to open a lid on the typewriter, insert the printing element in the typewriter and then close the lid. According to the present invention, when the lid is closed, means are provided for moving the carrier on which the printing element is mounted to the right side frame of the printer. A latch mounted on the carrier closes a switch for energizing a printing element motor in response to the carrier movement. The printing element motor rotates a printing element drive gear. An actuator, also mounted on the carrier, abuts a section of the right side frame and is caused to be rotated in response to further carrier movement. Rotation of the actuator in this manner permits the latch, previously prevented from moving by the actuator, to pivot towards the rotating printing element drive gear that is mounted on a common shaft with the printing element. When a finger on the latch engages a groove in the rotating drive gear, the printing element is in its home position, the shaft on which the printing element and drive gear is mounted ceases rotation and the switch is opened for deenergizing the printing element motor. The carrier is thereafter moved to the last print position occupied by the carrier when the lid was opened to be in proper orientation for printing to commence.

BRIEF DESCRIPTION OF THE DRAWING

A further understanding of the present invention may be had when the following detailed description is read in conjunction with the accompanying drawings, in which.

DETAILED DESCRIPTION OF THE PREFERRED EMBODIMENT

Figure 1:
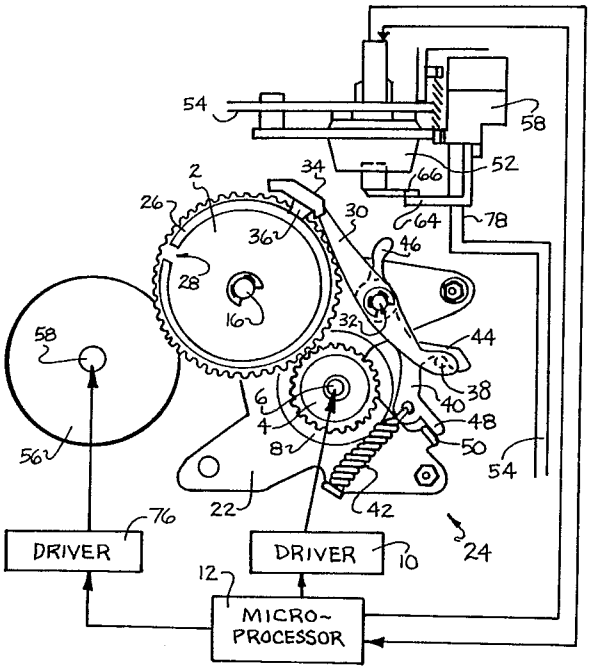
FIG. 1 is a rear elevational view of the typewriter lid actuated printing element homing device of the present invention showing the device in its rest position.
Figure 4:
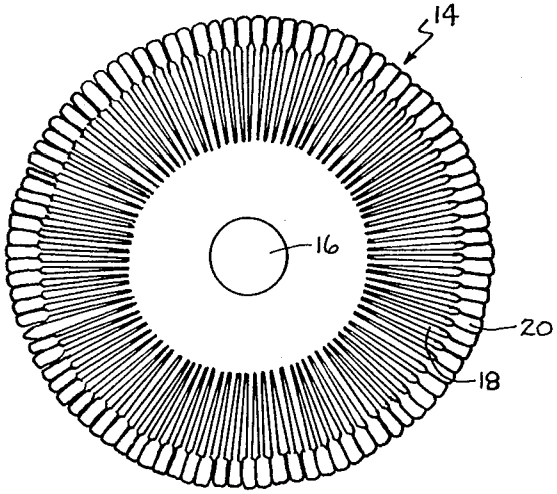
FIG. 4 is a front elevational view of a typewriter lid actuated printing element of the type with which the present invention may be used.

There is shown in FIG. 1 a printing element drive gear 2 which is driven by a gear 4 on a shaft 6 of a printing element drive motor 8. The shaft 6 is caused to be rotated by a driver 10 under control of a microprocessor 12. The printing element drive gear 2 and a rotary printing element 14 (see FIG. 4) are mounted on a common drive shaft 16, whereby the printing element 14 and the drive gear 2 are rotated together. The rotary printing element 14 is of the daisy wheel printer type and includes a number of resilient pads 18 which support print characters 20 on their extremities.

The printing element drive gear 2, gear 4 and rotary printing element 14 are mounted on a frame 22 of a carrier (shown generally as 24) which moves along a print line direction during the printing operations. As the carrier 24 is moved from print position to print position along the print line direction, the printing element 14 is rotated about its axis for character selection purposes. When the printing element 14 is in its proper position (i.e. when the character on the printing element 14 to be printed is opposite the desired print position), the carrier 24 is momentarily stopped as a print hammer (not shown) on the carrier 24 impresses the character on the printing element 14 against an inking ribbon and a print receiving medium, such as paper (not shown).

The rear surface of the printing element drive gear 2 includes a flange 26 having a notch 28 therein. When the notch 28 is in a particular, and arbitrary, angular orientation with respect to the drive shaft 16, the printing element 14 is in its home position (i.e. a particular reference position known to the printing device).

Figure 3:
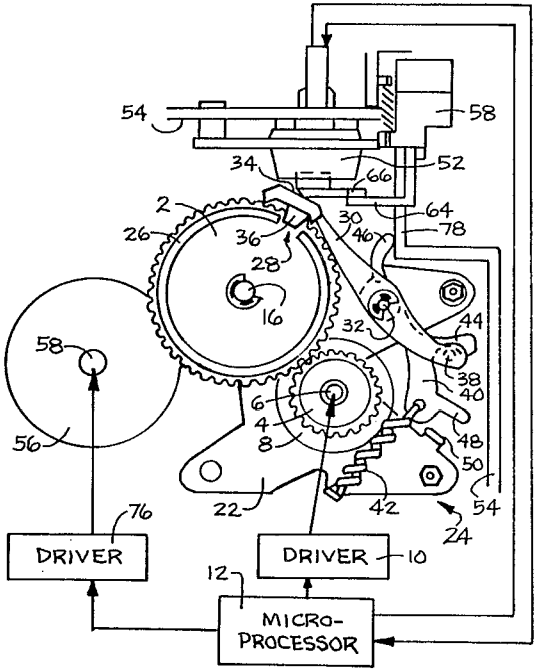
FIG. 3 is a rear elevational view of the typewriter lid actuated printing element homing device of the present invention showing the printing element engaged in its home position.
Figure 2:
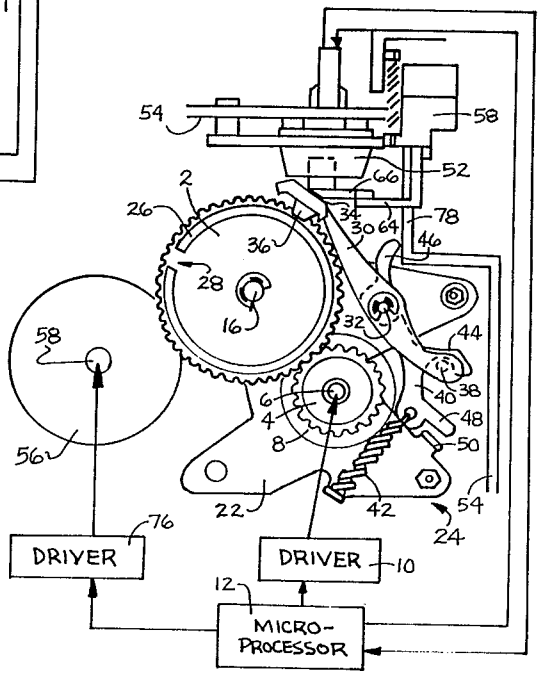
FIG. 2 is a rear elevational view of the typewriter lid actuated printing element homing device of the present invention showing the device in an intermediate operative position.

It should be noted that throughout this specification, all references to direction of carrier travel and the direction of rotation of the various elements are from the perspective of a viewer at the front of the printing device as viewed in FIG. 1–3. A latch member 30 is also mounted on the frame 22 and is free to rock about a pivot 32. The latch member 30 includes a cam surface 34 and a finger 36 which is adapted to enter the notch 28 of the flange 26 when the printing element 14 is in its home position. The latch member 30 also includes a pin 38 which extends toward the front of the printing device.

An actuator 40 mounted on the frame 22 is urged counterclockwise about the pivot 32 by a spring 42 which is also mounted on the frame 22. A first arm 44 on the actuator 40 has a first position in which it extends over the pin 38 of the latch member 30 to restrain the counterclockwise movement of the latch member 30 and has a second position in which it does not restrain the counterclockwise movement of the latch member 30. A second arm 46 on the actuator 40 is pivotable about the pivot 32. A third arm 48 on the actuator 40 abuts against a stop 50 on the frame 22 to limit the counterclockwise movement of the actuator 40.

A plunger switch 52 is mounted on a horizontal portion of the printing device frame 54 and is operative with the microprocessor 12 in a manner described more fully below. A carrier motor 56 having a rotor shaft 58 is mounted on the frame 22 in a known manner whereby rotation of the rotor shaft 58 in the clockwise and counterclockwise direction moves the carrier right and left, respectively, along carrier rails (not shown). A carrier motor arrangement of this type is used in various printing devices such as the aforementioned "XE 5000" typewriter sold by SCM Corporation.

Figure 5:
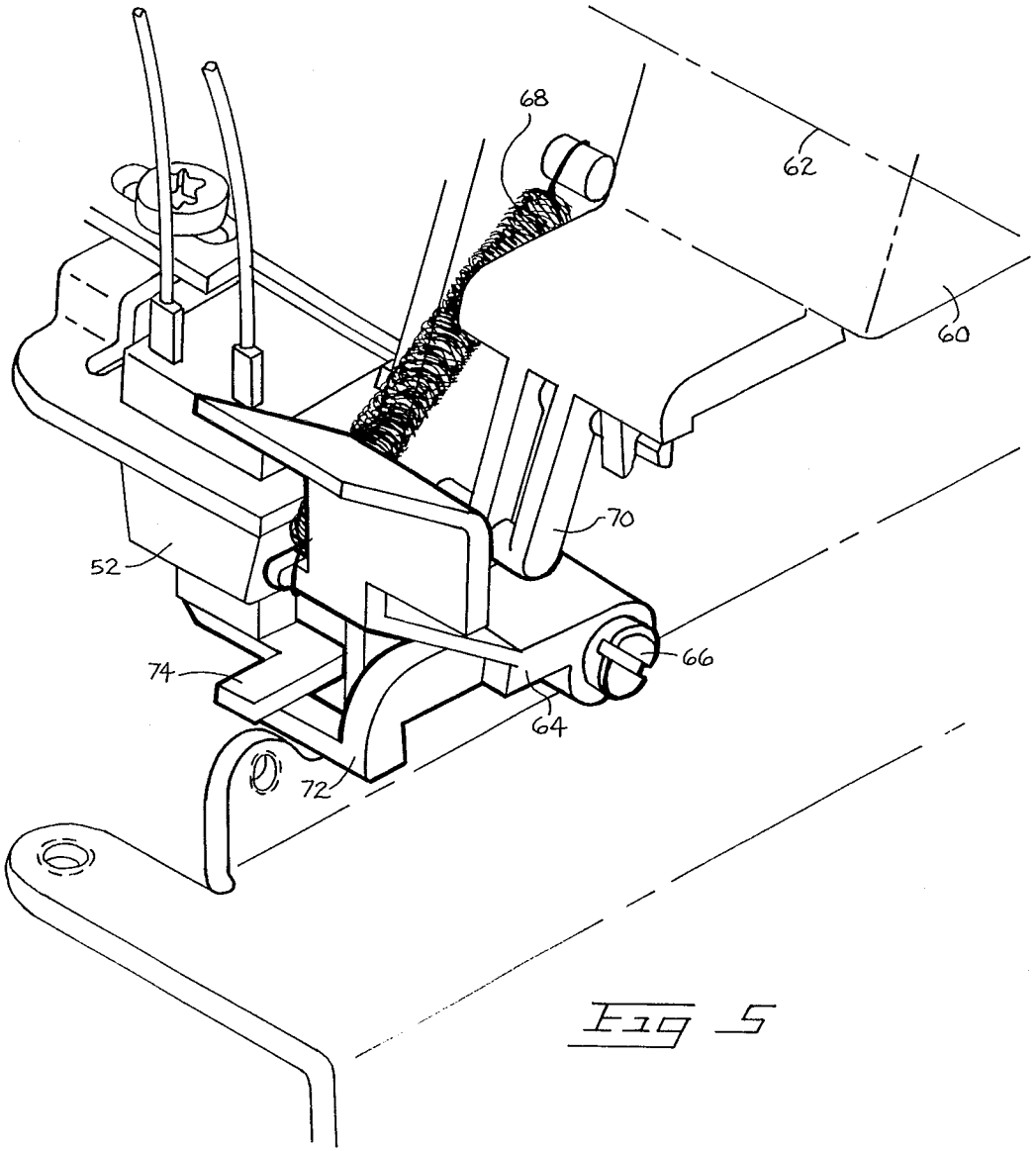
FIG. 5 is a partial isometric rear view showing the typewriter lid mechanism for actuating the printing element homing device.

There is shown in FIG. 5 a typewriter lid 60 which is manually pivoted counterclockwise about an axis 62 to its opened position in order to insert a new printing element or to replace a typewriter ribbon or cassette. After the new printing element is inserted or the typewriter ribbon is replaced, the lid 60 is manually pivoted clockwise to its closed position.

An actuator 64 is biased clockwise about a pivot screw 66 by a spring 68, one end of which is secured to the lid 60 and the other end of which is secured to the actutor 64 for closing the plunger switch 52. A finger 70 extends from typewriter lid 60 located above the actuator 64 in such a manner than when the typewriter lid 60 is closed, finger 70 prevents actuator 64 from pivoting clockwise.

An arm 72 of actuator 64 is located beneath an abutment 74 of the plunger switch 52 in such a manner that upward movement of arm 72 of actuator 64 against abutment 74 of the plunger switch 52 closed the plunger switch 52.

From the foregoing, it can be seen that when the typewriter lid 60 is closed, the actuator 64 is prevented from pivoting clockwise to close the plunger switch 52. Conversely, when the typewriter lid 60 is opened, the actuator 64 is free to pivot clockwise and close the plunger switch 52.

The operation of the typewriter lid actuated printing element homing device of the present invention will next be described. When the typewriter lid 60 is opened, as for example, to insert a new printing element, actuator 64 pivots clockwise by the spring 68 for closing the plunger switch 52 and thereby causing both the carrier motor phase and the carrier escapement position of the carrier 24 to be entered into the microprocessor memory. At this time the carrier 24 does not move to the left margin due to a time delay programmed in the microprocessor 12 for starting the initialization process. After insertion of the printing element and after closing the typewriter lid 60, a series of steps are performed to assure that the printing element 14 is properly seated with respect to the printing element drive shaft 6. These steps and the mechanism for achieving these steps are described in co-pending U.S. patent application Ser. No. 733,335, "Print Wheel Mounting," owned by the present assignee, abandoned and refiled as Ser. No. 935,656, now abandoned.

When the typewriter lid 60 is closed, the plunger switch 52 is opened by the actuator 64. The microprocessor 12 senses the opening of the plunger switch 52 and determines that the plunger switch 52 was closed by opening the typewriter lid 60. The microprocessor 12 then starts the initialization process. The program in the microprocessor 12 activates a driver 76 to cause rotation of the rotor shaft 58 clockwise driving the carrier 24 to the left in the direction of an indented portion 78 of the printing device frame 54. As the carrier 24 moves to the left to a first position, the cam surface 34 of the latch member 30 closes the plunger switch 52 (see FIG. 2), which transmits a signal to microprocessor 12. In response to that signal, the program in microprocessor 12 activates the driver 76 causing limited rotation of the rotor shaft 58 clockwise, and incremental movement of the carrier 24 approximately .100 inch to the left to a second position.

As the carrier 24 is moved to the left to the second position, the second arm 46 of the actuator 40 abuts against the indented portion 78 of the printing device frame 54, causing clockwise movement of the actuator 40 and the first arm 44 thereon. As the first arm 44 pivots clockwise about the pivot 32, the first arm 44 no longer prevents the latch member 30 from pivoting clockwise about the pivot 32.

Upon carrier 24 completing its incremental movement to the left, the program in the microprocessor 12 activates the driver 10 to cause counterclockwise rotation of the shaft 6 and the gear 4, which in turn causes clockwise rotation of the printing element drive gear 2 and the flange 26 thereon. The printing element 14 will be in its home position when the notch 28 of the flange 26 is opposite the finger 36 of the latch member 30 and, at that position, the finger 36 of latch member 30, being biased by an internal spring tension in the plunger switch 52, enters and engages the notch 28 of the flange 26 to latch the printing element 14 in its home position.

As the finger 36 pivots clockwise and enters the notch 28 of the flange 26, the cam surface 34 of the latch member 30 pivots clockwise opening the switch 52. The opening of switch 52 transmits a signal to the microprocessor 12 causing the program in microprocessor 12 to deactive the driver 10 which deenergizes the printing element drive motor 8. The rotation of the printing element drive gear 2 is stopped when the finger 36 enters the notch 28 of the flange 26. The deenergizing of the printing element drive motor 8 and stopping rotation of the printing element drive gear 2 occur substantially simultaneously. In this manner, unlike prior art devices, the noise which would otherwise be caused by the print element drive motor 8 continuously trying to rotate against the finger 36 is eliminated. Also, the signal to the microprocessor 12 from the opening of the switch 52 enables the program in microprocessor 12 to cause rotation of the rotor shaft 58 clockwise. In that manner, carrier 24 is driven rightward to and repositioned to its prior carrier escapement position. The printing element 14 is now in proper position for the printing operation to commence.

It can now be seen that a single switch, the plunger switch 52, controls the operation of the printing element drive motor 8 and controls the operation of the carrier motor 56.

Figure 6:
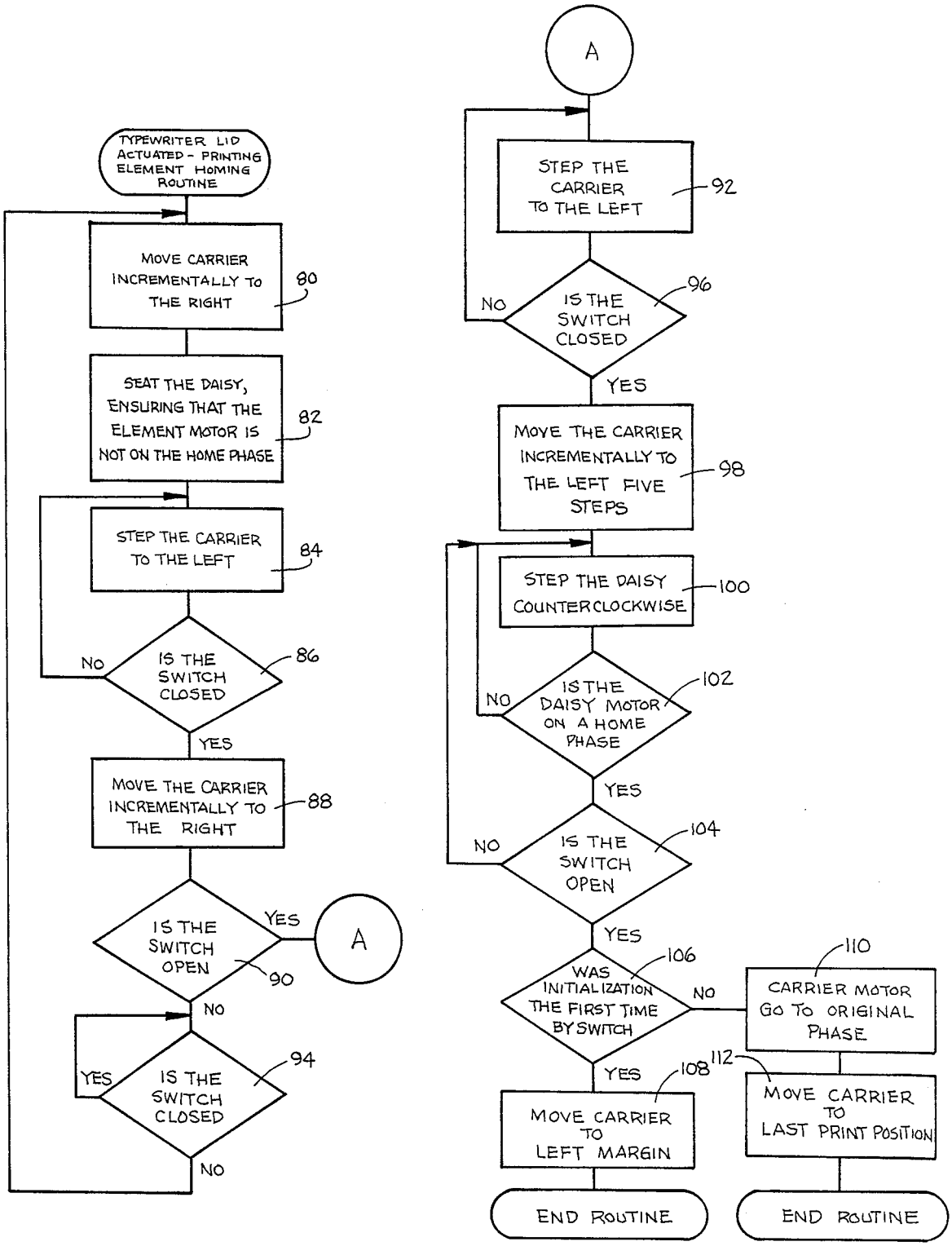
FIG. 6 is a flow chart of the typewriter lid actuated printing element homing device according to the present invention.

In the flow chart of FIG. 6, the following conventional box shapes are used: boxes with semi-circular ends represent the start of a routine, a rectangular box represents a processing function or an operation, and a diamond box represents a decision for selecting one of two alternative outputs. As with most microprocessors, there is present a regular program idling loop in which rounds or sequential interrogatories of the various registers of flags are made and, depending on the status of these registers or flags, certain routines or operations are initiated. For clarity and ease of description, only a general description of the portions of routines relevant to the present typewriter lid actuated printing element homing device features are depicted in the flow chart.

In accordance with the present invention, in the flow chart of FIG. 6, there is a routine entitled "Typewriter Lid Actuated Printing Element Homing Routine." The directions for moving the carrier 24 and for stopping the daisy 14 included in the flow chart of FIG. 6 are described as viewing the front of the typewriter. It should be noted that the present invention is useful in conjunction with the power-on printing element homing device described in the aforesaid co-pending U.S. Pat. No. 4,746,235, and, therefore, the following flow chart includes steps to determine whether the printing element homing device was initiated in response to the closure of typewriter lid 60 in which case the carrier 24 is moved to its prior escapement position (i.e. its escapement position at the time printing element was inserted), or whether the printing element homing device was initiated in response to the power switch being turned on in which case the carrier 24 is moved to its left-hand margin position.

The first operation box 80 denotes the incremental movement of the carrier 24 to the right and occurs immediately after the power switch is turned on. That assures that the carrier 24 is a sufficient distance from switch 52, so that the closure of switch 52 (and the engagement of the homing mechanism) will not prematurely occur. The next operation box 82 denotes the series of steps which are performed to assure that the printing element 14 is properly seated with respect to the printing element drive shaft 16. More specifically, after the printing element 14 is seated in accordance with the steps described in U.S. patent application Ser. No. 733,335, the printing element drive motor 8 is stopped two phases from its home phase to insure that the homing device does not engage during carrier initialization.

The flow proceeds to operation box 84 wherein the carrier 24 is stepped to the left in the direction of the plunger switch 52 so that the plunger switch 52 eventually closed by cam surface 34 of the latch number 30, thereby establishing the horizontal reference point from which subsequent carrier movement is measured.

The next box 86 is decision to determine if the plunger switch 52 has been closed by the cam surface 34 of the latch member 30. If the determination is NO, then the movement of carrier 24 to the left is continued. If the determination is YES, then an operation box 88 moves the carrier 24 incrementally to the right for the purpose of determing whether the plunger switch 52 was closed by the typewriter lid 60 being opened or whether it was caused by the carrier movement. To do this, decision box 90 determines whether the plunger switch 52 is open after the carrier 24 is moved to the right. If the plunger switch is open, that indicates that it had just previously been closed by the carrier movement (i.e. initializaton by the power switch) and the flow goes to operation box 92. In addition, the fact that initialization was caused by the power-on switch is entered into memory.

On the other hand, if the plunger switch 52 is closed after the carrier is moved to the right, that indicates that it had just previously been closed by the opening of the typewriter lid 60 (e.g. initialization by inserting a new printing element). In that case, decision box 94 causes the program to idle until the plunger switch 52 is opened by closure of typewriter lid 60. When the plunger switch 52 is opened in that manner, the flow returns to operation box 80 and the same sequence of previously described events occurs and the program continues to operation box 92. Thus, it will be seen that the program continues to operation box 92 whether initialization is caused by the opening of the typewriter lid 60 or by activation of the power-on switch.

At operation box 92, the carrier is stepped to the left until decision box 94 determines that the plunger switch 52 is closed. When that occurs, the horizontal reference point from which the subsequent carrier movement is redefined.

The flow then proceeds to operation box 98, and the carrier 24 is moved five steps to the left, although the amount of incremental movement will vary from device to device. The purpose of the leftward incremental motion is to make certain that the mechanism is fully engaged. In the next operation denoted by operation box 100, the printing element drive gear 2 is rotated counterclockwise and then at decision box 102, a determination is made as to whether the printing element motor 8 is in a home phase. If it is not, then the program returns to operation box 100, wherein the printing element motor 8 is rotated counterclockwise until decision box 102 determines that the printing element motor 8 is in a home phase.

When it is determined that the printing element motor 8 is in a home phase, the program continues to decision box 104 wherein a determination is made as to whether plunger switch 52 is open. If it is not opened, that means that the printing element motor 8 is not in its home position and the program returns to operation box 100 wherein the printing element motor 8 is rotated counterclockwise until decision box 104 determines that the plunger switch 52 is open. When that occurs, decision box 106 determines from memory whether the initialization was caused by the power-on switch. If it was, operation box 108 moves the carrier 24 to its left-handed margin position and the routine is completed.

If decision box 106 determines from memory that the initialization was caused by the opening of the typewriter lid 60, then operation box 110 causes the carrier motor 56 to return to its original position (which had previously been stored in memory), and operation box 112 causes the carrier 24 to move to its original escapement position (which had also previously been stored in memory), thereby completing the routine.

It is to be understood that the present disclosure of a typewriter lid actuated printing element homing device has been made only by way of example, and that numerous changes in details of construction and the combination and arrangement of parts may be resorted to without departing from the true spirit and scope of the invention as hereinafter claimed.

What is claimed is:

1. In a typewriter having a lid thereon which is opened to permit insertion of a new printing element and which is closed thereafter, a typewriter lid actuated printing element homing and carrier reposition device comprising:

a. a carrier moveable by a carrier motor along a print line direction during the printing operation;

b. a printing element mounted on the carrier for movement therewith and having a home position;

c. means including a printing element motor for rotating the printing element to its home position;

d. a common switch responsive to the opening and closing of the typewriter lid for controlling the carrier motor and the printing element motor;

e. means in response to closing of the typewriter lid for latching the printing element in its home position;

f. means for repositioning the carrier to the last print position occupied by the carrier when the lid was opened; and g. control means mounted on the carrier for movement therewith, the control means being operable to rotate the printing element to its home position and to latch the printing element in its home position and to open the switch for de-energizing the printing element motor.

2. A typewriter lid actuated printing element homing and carrier reposition device as set forth in claim 3 wherein the control means include a drive member coupled to the printing element, a latch member for engaging the drive member to latch the printing element in its home position, and an actuator for permitting the latch member to latch the printing element in its home position when the carrier has moved to the second predetermined position.

3. A typewriter lid actuated printing element homing and carrier reposition device as set forth in claim 2 including means responsive to movement of the carrier to a first position for closing the switch.

4. A typewriter lid actuated printing element homing and carrier reposition device as set forth in claim 3 including means responsive to movement of the carrier to a second position for opening the switch.

5. A typewriter lid actuated printing element homing and carrier reposition device as set forth in claim 4 further comprising an abutment for moving the actuator for permitting the latch member to latch the printing element in its home position in response to the carrier moving to the second predetermined position.

6. A typewriter lid actuated printing element homing and carrier reposition device as set forth in claim 5 further comprising a microprocessor and a program stored in the microprocessor for moving the carrier to its correct escapement position after the printing element is in its home position and the printing element motor is deenergized.

7. A typewriter lid actuated printing element homing and carrier reposition device as set forth in claim 6 including means for storing a correct carrier escapement position in memory.

8. A typewriter lid actuated printing element homing and carrier reposition device as set forth in claim 7 including means for storing a correct carrier motor phase in memory.

9. A typewriter lid actuated printing element homing and carrier resposition device as set forth in claim 8 wherein the means for storing the correct escapement position and carrier motor phase in memory includes an actuator engageable by the typewriter lid for closing the switch when the typewriter lid is opened.

10. A typewriter lid actuated printing element homing and carrier reposition device as set forth in claim 9 wherein the latch member and the actuator for permitting the latch member to latch the printing element in its home position are mounted on a common pivot.

11. A typewriter lid actuated printing element homing and carrier reposition device as set forth in claim 10 wherein the drive member is mounted on a common shaft with the printing element for rotation therewith.

12. A typewriter lid actuator printing element homing and carrier reposition device as set forth in claim 11 wherein the drive member has a notch therein and the latch member has a finger which is biased into engagement with the notch to latch the printing element in its home position.

13. A typewriter lid actuated printing element homing and carrier reposition device as set forth in claim 12 wherein the actuator includes a first arm which restrains the latch member from movement.

14. A typewriter lid actuated printing element homing and carrier reposition device as set forth in claim 13 wherein the actuator for permitting the latch member to latch the printing element in its home position includes a second arm which when moved causes the actuator to permit the latch member to latch the printing element in its home position.

15. A typewriter lid actuated printing element homing and carrier reposition device as set forth in claim 14 wherein the actuator includes a third arm which abuts against a stop to limit the movement of the actuator.

* * * * *